US006002838A

United States Patent [19]

Nir

[11] Patent Number: 6,002,838

[45] Date of Patent: Dec. 14, 1999

[54] DEVICE FOR STORING AND DISCHARGING OF VISCOUS LIQUID

[76] Inventor: Ari Nir, 2600 Netherland Ave., Riverdale, N.Y. 10463

[21] Appl. No.: 08/922,762

[22] Filed: Sep. 3, 1997

[51] Int. Cl.[6] ..... F24H 1/18

[52] U.S. Cl. ..... 392/449; 165/108

[58] Field of Search ..... 392/449, 441, 392/450, 451, 452, 458, 454; 126/344, 361, 362; 137/340, 341; 165/108, 110, 132

[56] References Cited

U.S. PATENT DOCUMENTS

| | | | |
|---|---|---|---|
| 2,607,535 | 8/1952 | Moore | 237/8 R |
| 4,242,569 | 12/1980 | Kayser | 219/314 |
| 4,593,169 | 6/1986 | Thomas | 219/688 |
| 4,844,927 | 7/1989 | Morris, II et al. | 426/307 |

*Primary Examiner*—Mark Paschall
*Assistant Examiner*—Thor Campbell
*Attorney, Agent, or Firm*—Ilya Zborovsky

[57] ABSTRACT

A device for storing and discharging a viscous liquid has a unit forming a storage chamber for storing a viscous liquid, a unit forming at least one mixing chamber which communicates with the storage chamber, and a unit for heating the viscous liquid in the mixing chamber so as to reduce viscosity of the liquid in the mixing chamber and permit a withdrawal of the liquid from the mixing chamber, while the liquid in the storage chamber is heated because of the communication of the storage chamber with the mixing chamber and flow from the storage chamber into the mixing chamber.

3 Claims, 4 Drawing Sheets

DEVICE FOR STORING AND DISCHARGING OF VISCOUS LIQUID

BACKGROUND OF THE INVENTION

The present invention relates to a device for storing and discharging of viscous liquids.

Storing and discharging of viscous liquids in containers at low temperatures is very complicated because of high viscosity of such liquids. The viscosity of the liquid substantially reduces when the liquid is heated; however, a high quantity of heat is consumed for this purpose.

SUMMARY OF THE INVENTION

Accordingly, it is an object of present invention to provide a device for storing and discharging of viscous liquids, which avoids the disadvantages of the prior art.

In keeping with these objects and with others which will become apparent hereinafter, one feature of present invention resides, briefly stated, in a device for storing and discharging of a viscous liquids, comprising means forming a storage chamber for storing a viscous liquid; means forming a mixing chamber which communicates with said storage chamber; and means for heating the liquid in said mixing chamber so as to withdraw the liquid from the mixing chamber while an area of said storage chamber adjoining said mixing chamber is thereby heated to provide a flow of the liquid from said storage chamber into said mixing chamber.

When the device is designed in accordance with the present invention, it eliminates the disadvantages of the prior art and provides for an easy and simple withdrawal of the viscous liquid from the device.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
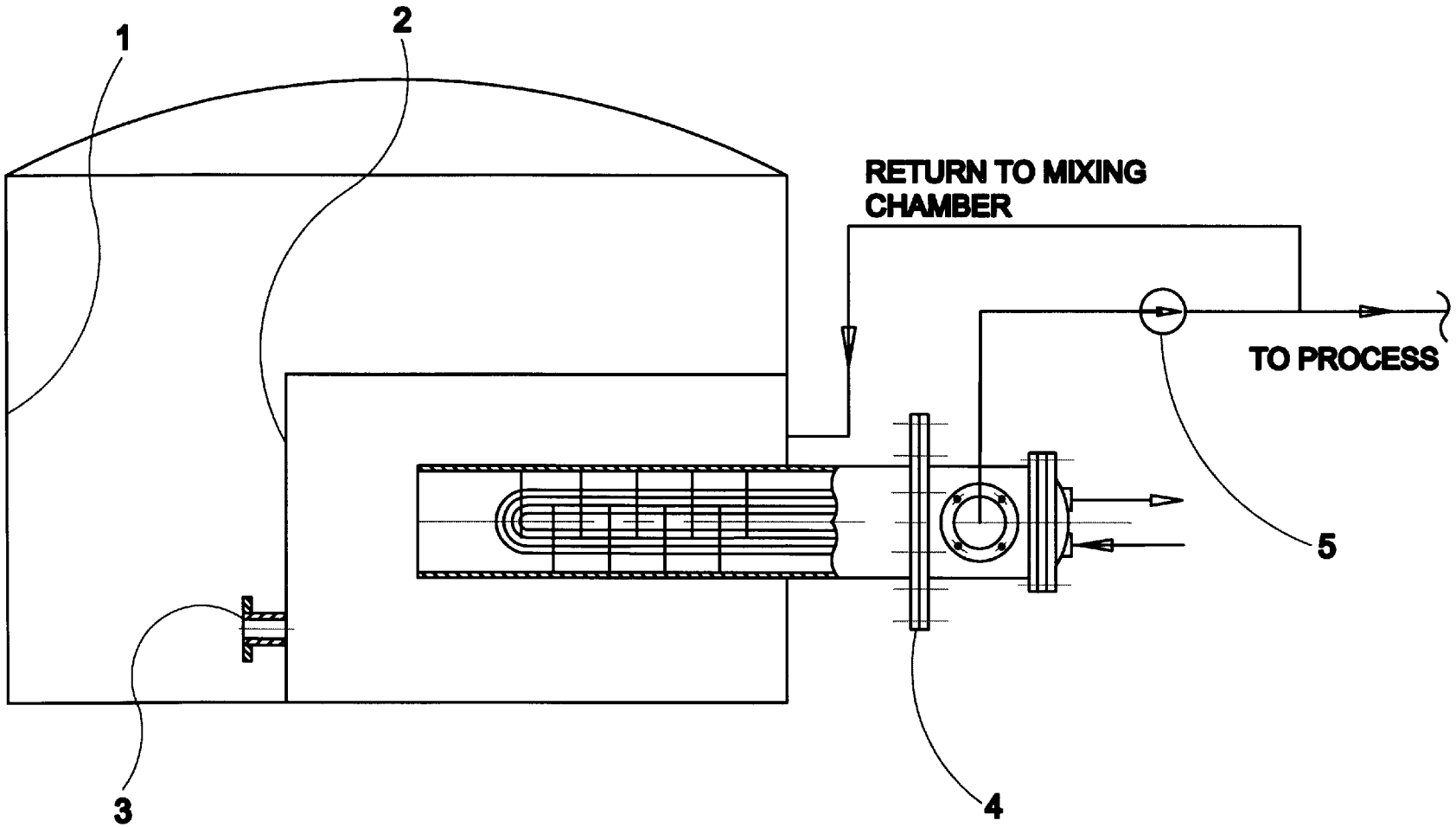
FIG. 1 is a view showing a device for storing and discharging of viscous liquid in accordance with a first embodiment of the present invention.

A device for storing and discharging of a viscous liquid in accordance with a first embodiment of the present invention is shown in FIG. 1 and includes a storage chamber which is identified with reference numeral 1 and a mixing chamber which is identified with reference numeral 2. The storage chamber 1 has a greater volume than the mixing chamber 2. The mixing chamber 2 can be formed as a section of the storage chamber 1, and its understood that several mixing chambers 2 can also be formed within the storage chamber 1. The mixing chamber 2 communicates with the storage chamber 1 through a port 3 which is openable and closeable by a user.

Fitting means is provided for heating the viscous liquid in the mixing chamber 2. The heating means in the shown embodiment is formed as a heat exchanger 4. The heat exchanger 4 has a shell into which the viscous liquid is introduced from the mixing chamber 2, and a pipe bundle into which a heating fluid is supplied for heating the viscous liquid in the shell. The heating fluid can be any fluid, such as a hot liqu)d, a hot vapor, etc. During the operation of the heat exchanger 4, the viscous liquid is heated in the mixing chamber 2 and reduces its viscosity, it is then displaced by a pump 5. One part of the displaced liquid can be supplied to a process, while another part can be returned to the mixing chamber 2 for heating of the viscous liquid in the mixing chamber.

The volume of the mixing chamber 2 is selected so that a quantity of the liquid located in it is sufficient for performing of a periodical process of consumption of the viscous liquid. The viscous liquid located in the storage chamber 1 has a low movability. However, since the walls of the mixing chamber 2 have a higher temperature than the liquid in the mixing chamber, because of the heating of the liquid in the mixing chamber, layers of the viscous liquid located in the storage chamber 1 and adjoining the hot walls of the mixing chamber 2 are being heated. Their viscosity is reduced and therefore the viscous liquid in these layers will flow into the mixing chamber 2 through the port 3.

An example of the operation of the inventive device is presented hereinbelow. A minimal permissible temperature of storage of a liquid fuel, at which it can move by a self flow is several degrees higher than a pour point which depends on the fuel type. Assuming that this value is 50° F., the low viscosity of the liquid fuel at this temperature will not be displaced by a pump. In order to reduce the viscosity, the temperature of the fuel in the mixing chamber 2 must be higher than the storage temperature, for example it must be equal to 80° F. For an efficient dispersion of the fuel during its burning, its temperature must be 160–240° F. As mentioned hereinabove, the heating of the liquid fuel is performed in the heat exchanger. If a certain part of the heated fuel is returned into the mixing chamber 2, the temperature of the mixture can be maintained at the level of 80° F. and therefore the liquid fuel can be displaced by the pump 5. If the liquid fuel in the mixing chamber is heated to a sufficiently high temperature by the heat exchanger or electrical heater, its volume should be selected so as to be sufficient for starting of a boiler. Therefore, a cold start with all accompanying disadvantages is prevented.

Figure 2:
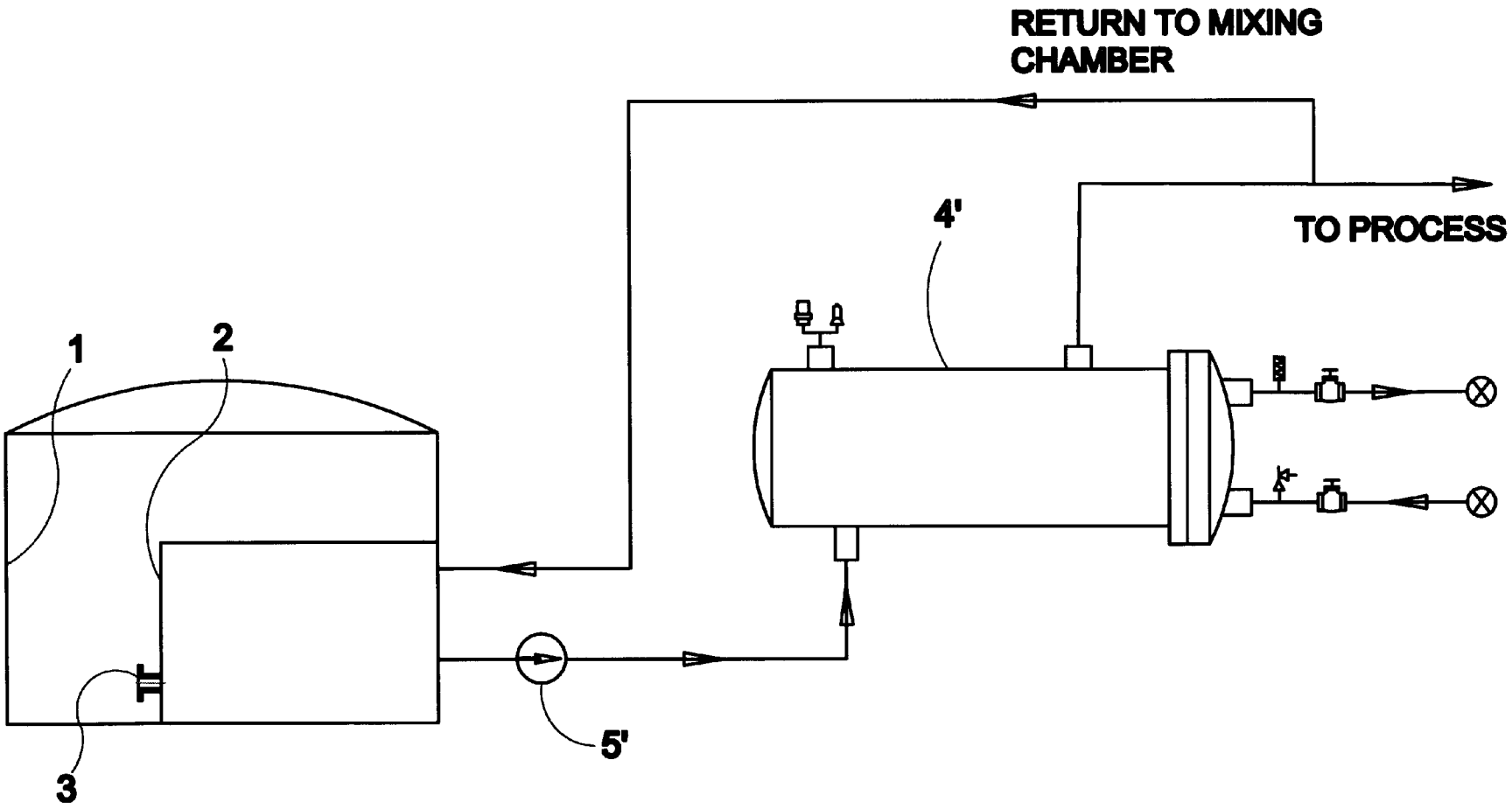
FIG. 2 is a view showing a device for storing and discharging of viscous liquid in accordance with a second embodiment of the present invention.

FIG. 2 shows another embodiment of the present invention. In this embodiment the heat exchanger 4' is located outside the mixing chamber 2, and the pump 5' is located in a line extending from the mixing chamber 2 to the heat exchanger 4'. In other aspects, the construction and the operation of the inventive device is substantial similar to the construction and the operation of the device of FIG. 1.

Figure 3:
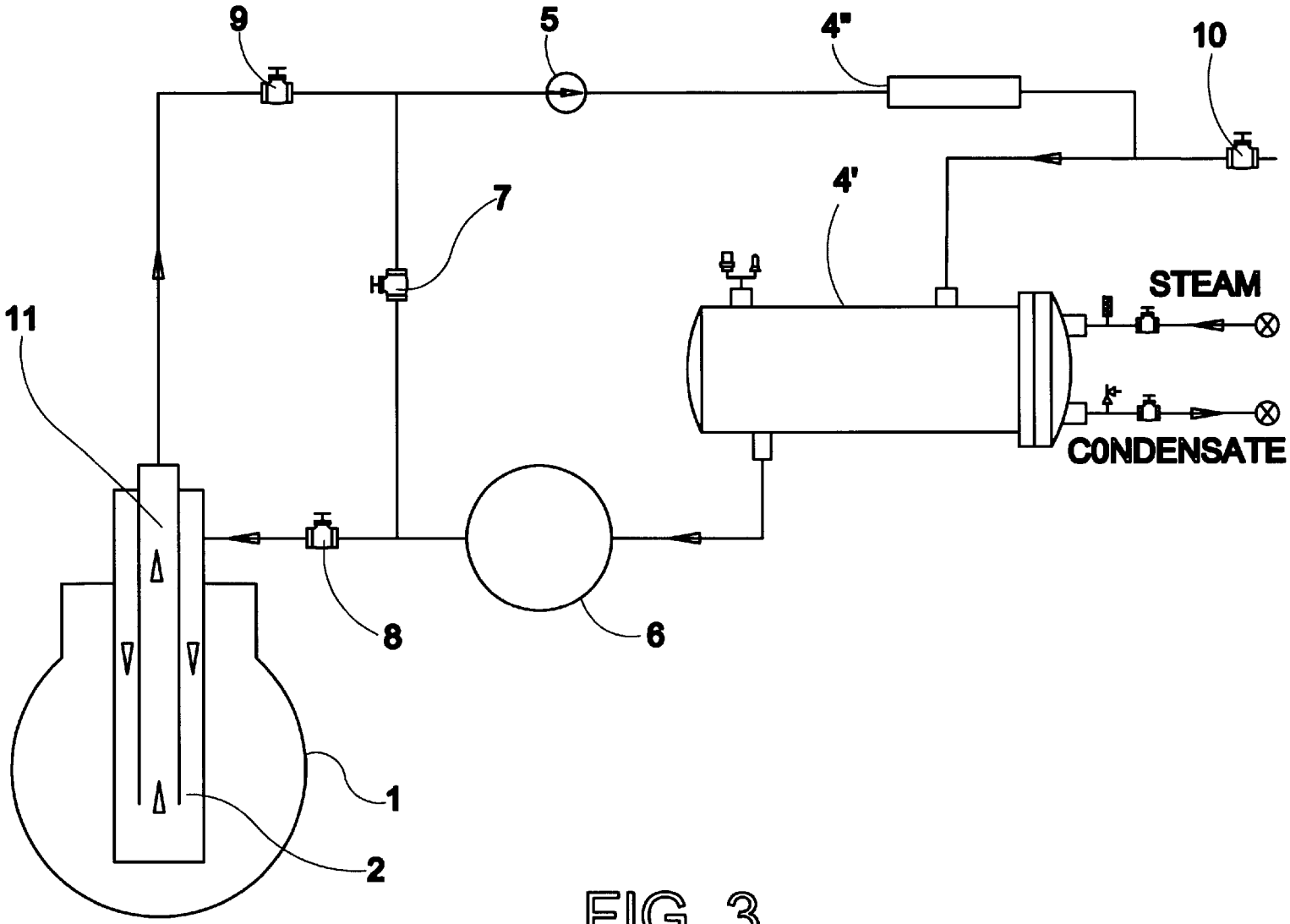
FIG. 3 is a view showing a device for storing and discharging of viscous liquid in accordance with a third embodiment of the present invention.

In the device in accordance with the embodiment of FIG. 3, the mixing chamber has a suction pipe 11 forming an inner passage inside the suction pipe and an outer passage outside the suction pipe. The heating means include an electrical heater 4" and a heat exchanger 4'. A pump 5 is provided between the suction pipe 11 of the mixing chamber 2 and the electrical heater 4", while a startup storage tank 6 is located between the outer space of the suction pipe 11 in the mixing chamber 2 and the heat exchanger 4'. Reference numeral 7, 8, 9, 10 identify corresponding valves for closing and opening of corresponding conduits. In this embodiment the viscous liquid is heated by the heating element 4', 4" and transported by the pump 5. The heated liquid with reduced viscosity is supplied to the startup storage tank and then from the storage tank into the outer space of the suction pipe 11. The liquid with the reduced viscosity is withdrawn from the inner space of the suction pipe 11. At the same time, the layers of the liquid which are located in the storage chamber 1 and adjoin the walls of the mixing chamber 2 are heated, their viscosity is reduced, and the liquid from these layers is introduced through the lower open end of the mixing chamber 2 into the mixing chamber.

Figure 4:
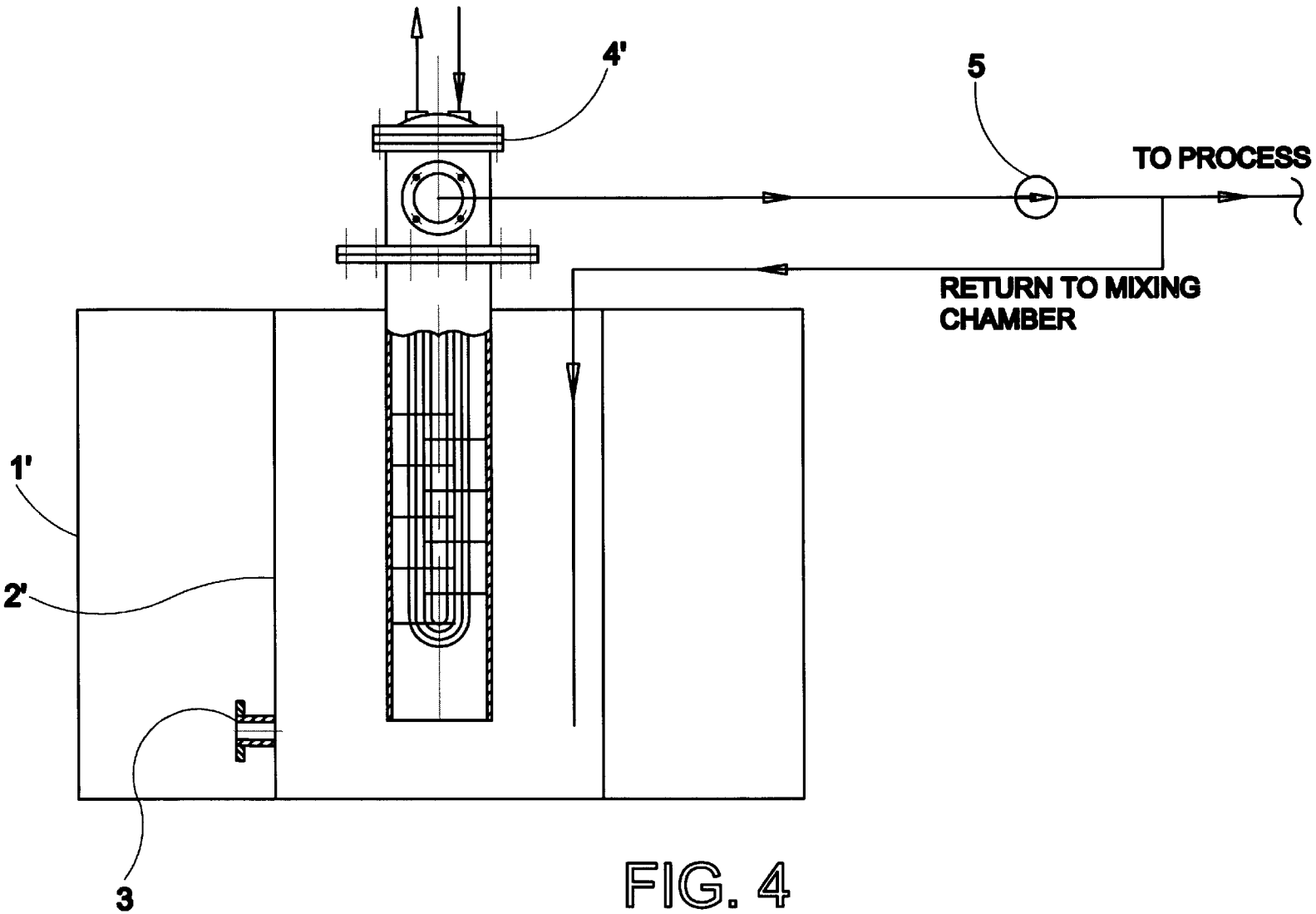
FIG. 4 is a view showing a device for storing and discharging of viscous liquid in accordance with a fourth embodiment of the present invention.

In the embodiment of FIG. 4, the mixing chamber 2' is also located inside the storage chamber 1', while the storage chamber 1' concentrically surround the mixing chamber 2' about a substantially vertical axis. The heat exchanger 4' is introduced into the mixing chamber 2' substantially coaxially with it. In other aspects, the construction and the operation of the device shown in FIG. 4 is substantially similar to the construction and the operation of the device shown in FIG. 1.

It will be understood that each of the elements described above, or two or more together, may also find a useful application in other types of constructions differing from the types described above.

While the invention has been illustrated and described as embodied in device for storing and discharging of viscous liquid, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for storing and discharging a viscous liquid, comprising means forming a storage chamber for storing a viscous liquid; means forming at least one separate mixing chamber which communicates with said storage chamber for introducing the viscous liguid from said storage chamber in said mixing chamber; means for withdrawing the viscous liquid from the mixing chamber, heating the withdrawn viscous liquid and reducing its viscosity, means for discharging one part of the withdrawn liquid with reduced viscosity; and means for returning another part of the withdrawn heated viscous liquid with reduced viscosity into the mixing chamber so as to mix it with the viscous liquid introduced from said storage chamber in the mixing chamber to produce a mixture with reduced viscosity.

2. A device as defined in claim 1, wherein said heating means include a heat exchanger communicating with said mixing chamber and providing heating and reduction of viscosity of the liquid withdrawn from said mixing chamber.

3. A method of storing and discharging a viscous liquid, comprising the steps of providing a storage chamber for storing a viscous liquid; communicating the storage chamber with at least one separate mixing chamber for introducing the viscous liquid from said storage chamber into said mixing chamber; withdrawing viscous liquid from the mixing chamber; heating the viscous liquid withdrawn from the mixing chamber and reducing its viscosity; discharging one part of the withdrawn viscous liquid with reduced viscosity; and returning another part of the withdrawn viscous liquid with reduced viscosity back into the mixing chamber so as to mix it with the viscous liquid introduced from said storage chamber in the mixing chamber to produce a mixture with reduced viscosity.

* * * * *